US006176820B1

(12) United States Patent
Westerberg

(10) Patent No.: US 6,176,820 B1
(45) Date of Patent: Jan. 23, 2001

(54) CONNECTION DEVICE FOR A CENTRIFUGAL SEPARATOR

(75) Inventor: Ronald Westerberg, Tullinge (SE)

(73) Assignee: Alfa Laval AB, Tumba (SE)

( * ) Notice: Under 35 U.S.C. 154(b), the term of this patent shall be extended for 0 days.

(21) Appl. No.: 09/380,819

(22) PCT Filed: Mar. 13, 1998

(86) PCT No.: PCT/SE98/00452

§ 371 Date: Sep. 8, 1999

§ 102(e) Date: Sep. 8, 1999

(87) PCT Pub. No.: WO98/40164

PCT Pub. Date: Sep. 17, 1998

(30) Foreign Application Priority Data

Mar. 13, 1997 (SE) ..... 9700912

(51) Int. Cl.[7] ..... B04B 11/00; B04B 15/00
(52) U.S. Cl. ..... 494/63; 494/70
(58) Field of Search ..... 494/43, 56, 63, 494/64, 68–73, 60, 85

(56) References Cited

U.S. PATENT DOCUMENTS 679,948 * 8/1901 Collins et al. .
689,878 * 12/1901 Hartmann .
732,520 * 6/1903 Collins et al. .
749,393 * 1/1904 Mersman .
2,302,168 * 11/1942 Ayres et al. .
2,622,796 * 12/1952 Steinacker et al. .
2,622,797 * 12/1952 Hemfort .
2,667,302 * 1/1954 Schmitz et al. .
3,217,981 * 11/1965 Johnsen .
4,299,256 * 11/1981 Bacehowski et al. .

FOREIGN PATENT DOCUMENTS 284862 12/1952 (CH) .
479710 7/1929 (DE) .
1303198 * 4/1987 (SU) ..... 494/56

* cited by examiner

*Primary Examiner*—Charles E. Cooley
(74) *Attorney, Agent, or Firm*—Fish & Richardson P.C.

(57) ABSTRACT

The invention concerns a connection device for a centrifugal separator having a rotor (2) in a casing (1) and a tubular member (7) attached to the casing and forming an inlet passage for media supply into the rotor (2) and an outlet passage (9, 10) for media discharge therefrom. The connection device includes a connection unit (15) forming a first channel (20) connectable to a first one of the passages (8) and a second channel (21) connectable to a second one of the passages (9). The unit (15) forms a recess (16) to receive the tubular member (7) in such a manner that an end portion of the tubular member projects therefrom. Moreover, the unit (15) is releasably mounted in one single piece onto the tubular member (7). A locking member (19) engages the end portion to press the unit (15) axially against the casing to a determined position in relation to the tubular member.

10 Claims, 3 Drawing Sheets

CONNECTION DEVICE FOR A CENTRIFUGAL SEPARATOR

THE BACKGROUND OF THE INVENTION AND PRIOR ART

The present invention refers to a connection device for a centrifugal separator having a rotor, provided in a stationary casing to rotate about an axis, and a tubular member fixedly attached to the casing and forming at least one inlet passage for the supply of media into the interior of the rotor and at least one outlet passage for the discharge of media from the interior of the rotor, the connection device comprising a connection unit forming a first connection channel arranged to be sealingly connected to a first of said passages and a second connection channel arranged to be sealingly connected to a second of said passages, wherein the connection unit forms a recess, extending through the unit and arranged to receive the tubular member in such a manner that an end portion of the tubular member projects from the unit, and wherein the connection unit is arranged to be releasably mounted in one single piece onto the tubular member.

Such connection devices for centrifugal separators are known, in which the connection channels are formed by separate conduit members provided onto the inlet and outlet passages of the centrifugal separator, i.e. the connection devices of conventional type comprise for each passage a conduit member which is releasably mounted. Consequently, when the conduit members are to be dismounted from their respective passage, which, for instance, is necessary in connection with cleaning and service of said inlet and outlet passages and of the interior of the centrifugal separator, each of the conduit members is to be removed separately and a plurality of components are to be released. Thus, by such an arrangement the mounting and the dismounting of the connection device are time consuming and require a great amount of work.

Another known connection device for a centrifugal separator comprises a unit having connection channels for the supply and the discharge of media. The unit is fixedly attached to a stationary casing by means of a number of screw bolts. Through the unit, an inlet pipe extends, which is threaded to a paring disk provided in the centrifugal separator and tightened to the unit. In order to enable dismounting of the unit, it is firstly necessary to unthread and remove she inlet pipe.

CH-A-284 862 discloses a connection device or a centrifugal separator having a rotor provided in a stationary casing and a tubular member attached to the casing and forming an inlet passage for the supply of media into the interior of the rotor and two outlet passages for the discharge of media from the interior of the rotor. The connection device comprises a connection piece having a first connection channel arranged to be connected to said inlet passage and second connection channels arranged to be connected to said outlet passages. The connection piece forms a recess extending through the unit to receive the tubular member. The piece is arranged to be clamped to the tubular member in a radial direction.

SUMMARY OF THE INVENTION

The object of the present invention is to overcome the problems mentioned above and to provide a connection device by which the dismounting and the mounting of the connections are simplified.

This object is obtained by the connection device initially defined and characterized in that the unit is arranged to be mounted onto the tubular member by a sliding movement in the direction of the axis, and that a locking member is arranged to engage said end portion of the tubular member in such a manner that the unit is pressed axially against the casing to a determined position in relation to the tubular member.

By such a unit, the passages and the interior of the centrifugal separator may in a quick and easy manner be uncovered, which facilitates repair and service work of the centrifugal separator, and thereafter the unit may be easily mounted to the centrifugal separator by a sliding displacement on the tubular member of the inlet and outlet passages. The unit may be kept integral, i.e. in one single piece, during the mounting and dismounting processes. Since the locking member is capable of pressing the unit against the casing of the centrifugal separator, a well-defined, determined position for the unit with respect to the centrifugal separator may be obtained in a reliable and easy manner.

According to an embodiment of the invention, the locking member is arranged to press the unit and the tubular member in opposite directions against the casing to said determined position. In such a manner, said determined position may be well defined both with respect to the unit and the tubular member.

According to a further embodiment of the invention, said end portion of the tubular member comprises an external thread and the locking member comprises a nut arranged to be threaded onto the thread of said end portion. A locking member embodied as a nut may be operated in a quick and easy manner by any person to perform repair or service work on the centrifugal separator Moreover, the nut enables the application of an appropriate force in the axial direction of the centrifuge rotor in order to achieve said determined position.

According to a further embodiment of the invention, each of the first and second connection channels is arranged to be connected to a flexible conduit member and said conduit members are provided to permit the dismounting of the unit from the centrifugal separator when being connected to the respective connection channel. Such an arrangement further facilitates the dismounting from and the following mounting of the unit to the tubular member of the centrifugal separator. Furthermore, such a unit removes the risk or mixing up the different conduit members to be connected during the following mounting operation.

According to a further embodiment of the present invention, the first connection channel and the second connection channel comprise a first orifice and a second orifice, respectively, in the recess. Thereby, the tubular member may comprise at least one inner pipe and an outer pipe, which are provided in such a manner that the outer pipe encloses the inner pipe, the first of said passages being formed by the inner pipe and the second of said passages being formed by a space between the outer and the inner pipes. Such a pipe arrangement allows for the supply and discharge of media to take place in a central position of the centrifugal separator and in addition the unit according to the invention may have a simple construction. Advantageously, the outer pipe is shorter than the inner pipe, the outer pipe extending essentially to the position at which the orifice of the second connection channel is located.

According to a further embodiment of the present invention, the first connection channel is arranged to form, in co-operation with the first passage, an inlet for the supply of a medium to the rotor and the second connection channel is arranged to form, in co-operation with the second passage, an outlet for the discharge of a medium from the rotor. Furthermore, the unit may comprise a third connection channel which is arranged to form, in co-operation with a third passage, a further discharge of a medium from the rotor.

BRIEF DESCRIPTION OF THE DRAWINGS

The present invention is now to be explained more closely by means of different embodiments, shown by way of example, and with reference to the drawings attached.

DETAILED DESCRIPTION OF DIFFERENT EMBODIMENTS

Figure 1:
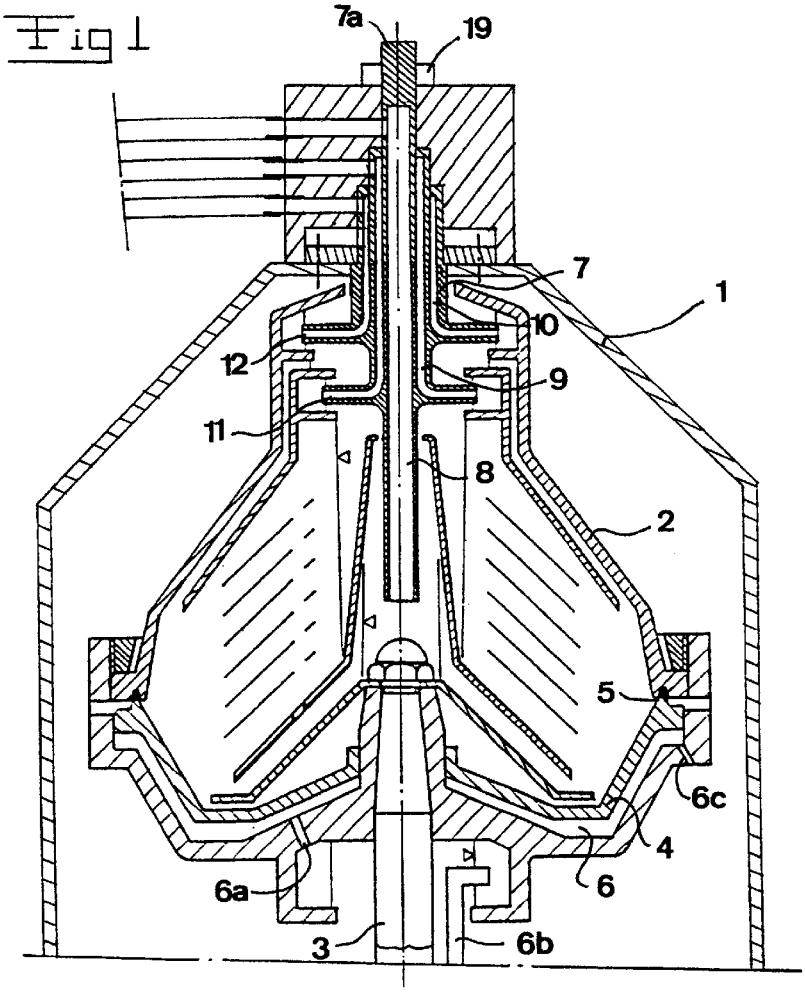
FIG. 1 discloses a schematical sectional view of a centrifugal separator having a connection device according to a first embodiment of the invention.

FIG. 1 discloses a centrifugal separator having a stationary casing 1 and a centrifuge rotor 2 which is enclosed in the casing 1. The centrifuge rotor 2 is mounted to a driving shaft 3 which by means of a driving member, not disclosed, is arranged to rotate the centrifuge rotor 2 about a rotational axis. A liquid mixture of substances, comprising a specifically lighter liquid phase, a specifically heavier liquid phase and possibly a sludge, which is specifically heavier than the heavy liquid phase, is supplied to the interior of the centrifuge rotor 2 disclosed by way of example. During operation, these substances are separated by the action of the centrifugal force so that separated sludge is collected in the radially outermost portions of the centrifuge rotor, the specifically lighter liquid phase is collected in the radially inner portions of the centrifuge rotor and the specifically heavier liquid phase is collected in a cylindrical layer therebetween. Within the centrifuge rotor 2, an axially displaceable disc-shaped valve member is provided for opening and closing a passage 5 which extends radially and through which the sludge may be discharged intermittently. The valve member 4 keeps the passage 5 in a closed position by the liquid pressure from the liquid in a so-called closing chamber 6 beneath the valve member 4. Liquid is supplied to the closing chamber 6, in the centrifuge rotor 2 disclosed, via the inlet members 6*a*, 6*b* comprising an inlet pipe 6*b* and is flowing out through a peripheral, throttle outlet 6*c*. When the passage 5 is to be opened for discharging sludge, the supply of the liquid is interrupted temporarily during a short period of time during which the closing chamber 6 is emptied of liquid completely or partly and the valve member 4 is displaced axially in an opening direction of the passage 5 by the pressure from the liquids and the sludge located above the valve member 4.

Figure 2:
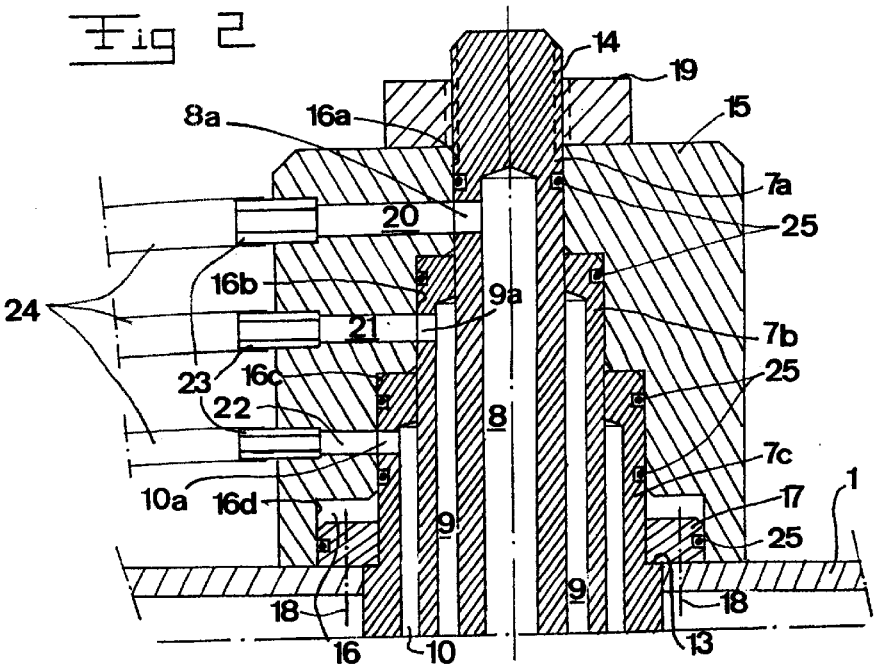
FIG. 2 discloses an enlarged sectional view of the connection device in FIG. 1.

The centrifugal separator is in a central position provided with a tubular inlet and outlet member 7, which is releasably mounted to the stationary casing 1 in such a manner that it extends into the interior of the centrifuge rotor 2 through an opening in the casing 1, and which forms passages for the supply and discharge of media. In particular, the tubular member 7 comprises an inlet passage 8 for the supply of the liquid mixture to be centrifugalized to the center of the centrifuge rotor 2, a first outlet passage 9 for the discharge of the relatively lighter liquid phase separated during operation and a second outlet passage 10 for the discharge of the relatively heavier liquid phase separated during operation The inlets of the first outlet passage 9 and the second outlet passage 10 are formed by first and second, respectively, disc-shaped discharge members 11, 2 which in the example disclosed are constructed in one respective piece together with the tubular member 7. In the embodiment disclosed, the tubular member 7 comprises three tipes 7*a*, 7*b* and 7*c* concentrically provided within each other. As appears more closely from FIG. 2, the inner of these pipes 7*a* forms the inlet passage 8 whereas the first outlet passage 9 is formed by a space between the inner pipe 7*a* and the intermediate pipe 7*b* enclosing the inner pipe 7*a*. The second outlet passage 10 is formed by a space between the intermediate pipe 7*b* and the outer pipe 7*c* enclosing the intermediate pipe 7*b*. The pipes 7*a*, 7*b* and 7*c* are fixed in relation to each other and connected to each other by any suitable connecting method, for instance welding, shrinkage, threading, etc. However, it is also possible to produce the three pipes 7*a*, 7*b* and 7*c* in one single piece. The outer pine 7*c* has a shoulder 13 and the inner pipe 7*a* has an outer thread 14 schematically disclosed at the end facing away from the centrifuge rotor 2. As appears from FIGS. 1 and 2, the three passages 8, 9 and 10 are concentric with respect to each other and with respect to the rotational axis of the centrifuge rotor 2. The inlet of the inlet passage 8 is formed by a radial hole 8*a* and the outlets of the first and second outlet passages 9, 10 are formed by a first radial hole 9a and a second radial hole 10*a*, respectively.

In order to connect the passages 8, 9 and 10 and thereby the interior of the centrifuge rotor 2 to a source and different receiving members (not disclosed), respectively, a connection device is provided on the tubular member 7. The connection device comprises a unit 15 which in the embodiments disclosed comprises a body shaped in essentially one piece. The unit 15 comprises a recess 16 extending through the body 15 and having such dimensions that the unit 15 may slide on the tubular member 7 in such a manner that it may abut the casing 1 of the centrifugal separator in its mounted state. Thus, the recess has a stepwise increasing diameter in the direction towards the casing 1. Consequently, a first portion 16*a* has a diameter which essentially corresponds to the outer diameter of the inner pipe 7*a*, and a second portion 16*b* has a diameter which essentially corresponds to the outer diameter of the intermediate pipe 7*b* and a third portion 16*c* has a diameter which essentially corresponds to the outer diameter of the outer pipe 7*c*. Furthermore, the recess 16 comprises a fourth portion 16*d* having a diameter which essentially corresponds to the diameter of an attachment plate 17 which is provided in a displaceable manner onto the outer pipe 7*c* to abutment against the shoulder 13. The attachment plate 17 is in the embodiments disclosed threaded to the casing 1 by means of screw members 18 schematically indicated. By means of a locking member 19, which in the example disclosed is a nut and which is arranged to engage the outer thread 14 of the inner pipe 7*a*, the unit 15 may thus be fixedly tightened to the casing 1 at the same time as the tubular member 7 is fixedly tightened to the attachment plate 77. Furthermore, the unit 15 comprises three connection channels 20, 21 and 22 which in the embodiment disclosed extend essentially radially with respect to the rotational axis and which are provided at such a height that the orifices of the connection channels 20, 21 and 22 are in alignment with the holes 8*a*, 9*a* and 10*a*, respectively. At the other ends of each of the connection channels 20, 21 and 22, a connecting nipple 23 is provided to which a flexible conduit member 24, for instance in the form of a hose is connected.

By threading away the locking nut 19, the whole unit 15, including the nipples 23 and the conduit members 24, may thus be lifted off in one single piece from the centrifugal separator and the tubular member 7. It is to be noted that the unit 15 may comprise means (not shown) to prevent the unit 15 from turning when the unit 19 is rotated. As further appears from FIG. 2, sealing members 25 in the shape of O-rings are provided in grooves extending around the tubular member 7 and suitably in each of the pipes 7*a*, 7*b* and 7*c*. A similar sealing member 25 may also be provided in a groove extending around the attachment plate 17.

Figure 3:
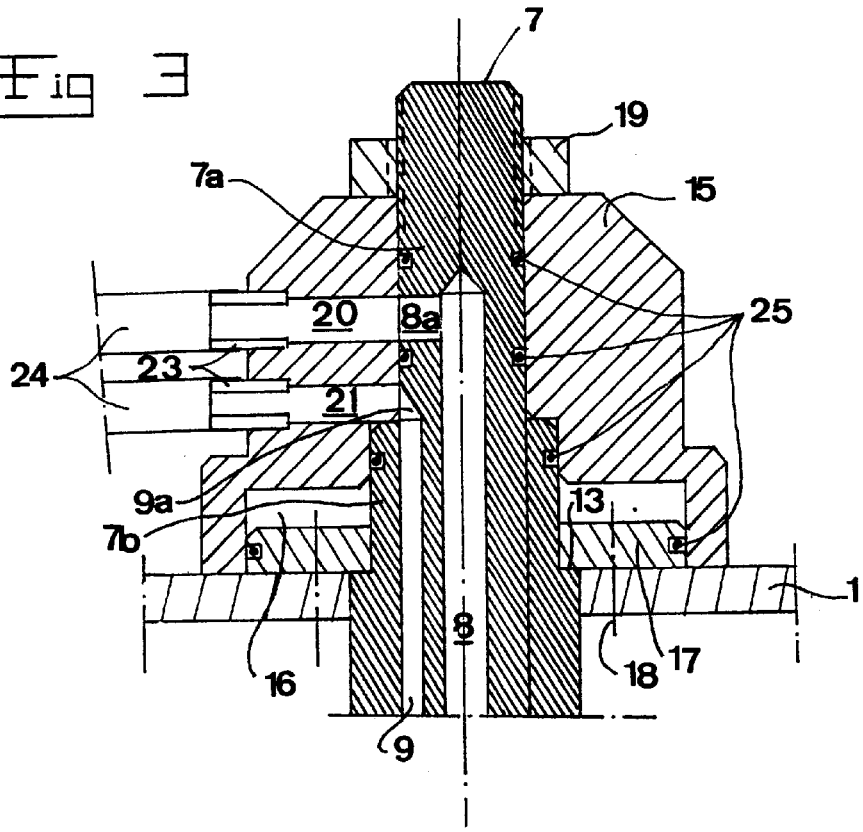
FIG. 3 discloses a sectional view of a connection device according to a second embodiment of the invention.

FIG. 3 discloses a second embodiment of the connecting device and the unit 15. It is to be noted that components having a corresponding function have been provided with the same reference signs in all embodiments disclosed. The unit 15 in the second embodiment differs from the unit 15 in the first embodiment in that it is adapted to a tubular member 7 comprising two concentric pipes 7*a* and 7*b* which enclose an inlet passage 8 and one single outlet passage 9. In this case the outlet passage 9 is shaped as an axial recess or groove at the outer side of the inner pipe 7*a*. The unit 15 comprises a first and a second connection channel 20 and 21, which are in alignment with the inlet of the inlet passage 8 and outlet of the outlet passage 9, respectively.

Figure 4:
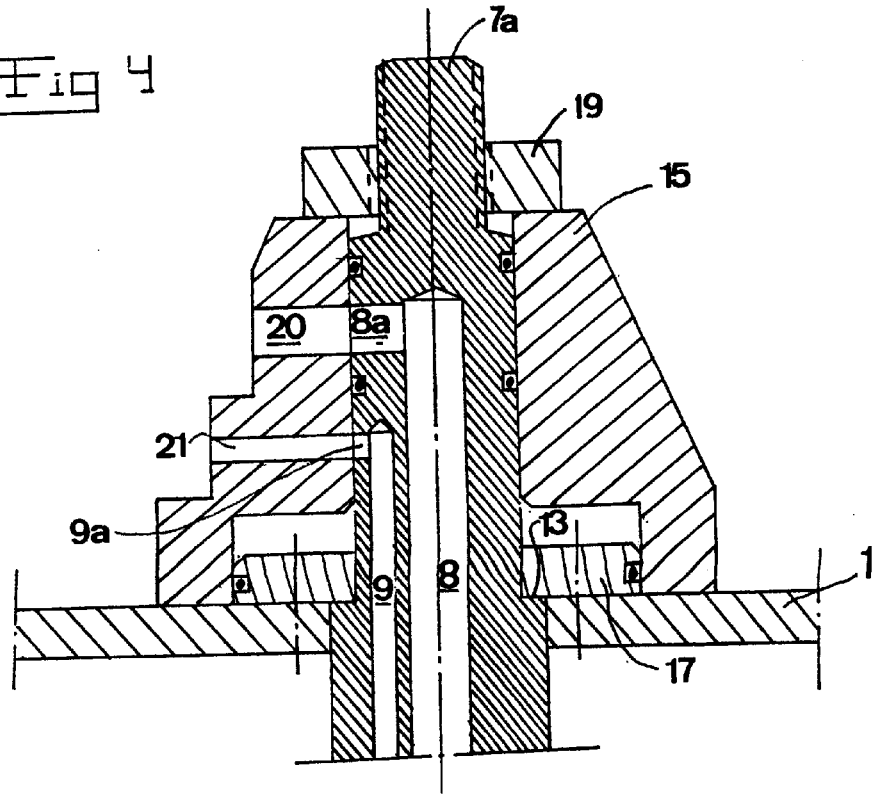
FIG. 4 discloses a sectional view of a connection device according to a third embodiment of the invention.

FIG. 4 discloses a third embodiment of the connecting device and the unit 15. In this case, the tubular member 7 comprises one single pipe 7*a* in which the inlet passage 8 is shaped as a concentric bore and the outlet passage 9 is shaped as a bore positioned beside the inlet passage 8.

Figure 5:
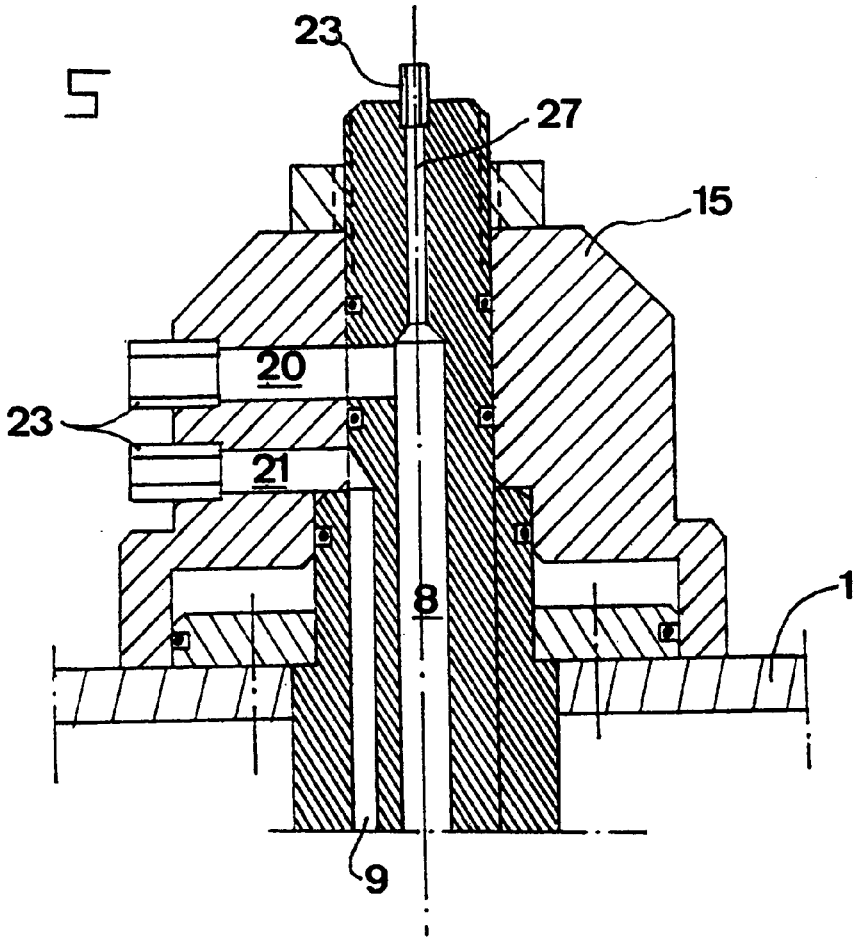
FIG. 5 discloses a sectional view of a connection device according to a fourth embodiment of the invention.

FIG. 5 discloses a fourth embodiment of the connection device and the unit 15, which differs from the unit 15 in the second embodiment in that the central inlet passage 8 of the tubular member 7 is provided with an additional connection channel 27, extending axially through the upper end, disclosed in FIG. 5, of the inner pipe 7, for the supply of any additional liquid such as cleaning liquids, diluting liquids or the like.

The embodiments disclosed in FIG. 3, 4 and 5 are used suitably in centrifugal separators in which one inlet passage for the supply and one outlet passage for the discharge of liquid media are needed, or in which passages possibly required in addition thereto are provided at the axially opposite end of the centrifugal separator, as through a hollow driving shaft.

The present invention is not limited to the embodiments disclosed above but may be varied and modified within the scope of the following claims. For instance, it is to be noted that the centrifugal separator may comprise more than one tubular member, for instance a first tubular inlet member for an inlet passage and a separate, second tubular outlet member for an outlet passage. In this case, the unit according to the invention comprises suitably two recesses, one for each separate tubular member. Furthermore, it is to be noted that the attachment of the unit 15 to the casing 1 and to the centrifugal separator may be constructed in many different ways. For instance, it is possible to dispense with the shoulder 13 and attach the unit 15 directly to the attachment plate 17, for instance by means of a screw joint.

Furthermore, it is to be noted that the sealing members 25 may be provided in a different way from those disclosed. For instance, a sealing member 25 may be provided on both axial sides of each connection channel 20, 21 and 22.

What is claimed is:

1. A centrifugal separator comprising a rotor (2), a stationary casing (1) and a connection device, said rotor (2) being in the casing (1) and being rotatable about an axis, and said separator further comprising a tubular member (7) fixedly attached to the casing and forming at least one inlet passage (8) for the supply of media into the interior of the rotor (2) and at least one outlet passage (9, 10) for the discharge of media from the interior of the rotor (2), the connection device comprising a connection unit (15) forming a first connection channel (20) sealingly connected to a first of said passages (8) and a second connection channel (21) sealingly connected to a second of said passages (9), wherein the connection unit (15) forms a recess (16), extending through the unit for receiving the tubular member (7) in such a manner that an end portion of the tubular member (7) projects from the unit (15), and wherein the connection unit (15) is releasably mounted in one single piece onto the tubular member (7), wherein the unit (15) is mounted onto the tubular member (7) by a sliding movement in the direction of the axis, and a locking member (19) engages said end portion of the tubular member (7) so that the unit (15) presses axially against the casing (1) to a determined position in relation to the tubular member.

2. The centrifugal separator according to claim 1, wherein the locking member (19) presses the unit (15) and the tubular member (7) in opposite directions against the casing to said determined position.

3. The centrifugal separator according to claim 1, wherein said end portion of the tubular member (7) comprises an external thread (14) and the locking member (19) comprises a nut threaded onto the thread (14) of said end portion.

4. The centrifugal separator according to claim 1, wherein each of the first and second connection channels (20, 21) connects to a flexible conduit member (24) and said conduit members (24) permit the dismounting of the unit (15) from the centrifugal separator while still connected to the respective connection channel (20, 21).

5. The centrifugal separator according to claim 1, wherein the first connection channel (20) and the second connection channel (21) comprise a first orifice (16*a*) and a second orifice (16*b*), respectively, in the recess.

6. The centrifugal separator according to claim 5, wherein the tubular member (7) comprises at least one inner pipe (7*a*) and an outer pipe (7*b*) , such that the outer pipe encloses the inner pipe, and wherein the outer pipe (7*b*) is shorter than the inner pipe (7*a*) and the outer pipe extends to essentially one position at which the orifice of the second connection channel (21) is located.

7. The centrifugal separator according to claim 1, wherein the tubular member (7) comprises at least one inner pipe (7*a*) and an outer pipe (7*b*) , so that the outer pipe encloses the inner pipe, a first passage (8) being formed by the inner pipe and a second passage (9) being formed by a space between the outer and the inner pipes (7*a, 7b*).

8. The centrifugal separator according to claim 7, wherein the outer pipe (7*b*) is shorter than the inner pipe (7*a*) and the outer pipe extends to essentially one position at which an orifice of the second connection channel (21) is located.

9. The centrifugal separator according to claim 1, wherein the first connection channel (20) forms, in co-operation with a first passage (8), an inlet for the supply of a medium to the rotor (2) and the second connection channel (21) forms, in co-operation with a second passage (9), an outlet for the discharge of a medium from the rotor (2).

10. The centrifugal separator according to claim 9, wherein the tubular member comprises a third passage, and the unit (15) comprises a third connection channel, said third connection channel forming, in co-operation with the third passage, a further outlet for the discharge of a medium from the rotor (2).

* * * * *

UNITED STATES PATENT AND TRADEMARK OFFICE

CERTIFICATE OF CORRECTION

PATENT NO. : 6,176,820 B1 
DATED : January 23, 2001
INVENTOR(S) : Ronald Westerberg It is certified that error appears in the above-identified patent and that said Letters Patent is hereby corrected as shown below:

Column 3,
Line 59, change "2" to -- 12 --.
Line 62, change "ripes" to -- pipes --.

Column 4,
Line 44, change "77" to -- 17 --.

Column 5,
Line 35, insert -- 15 -- after "unit."

Signed and Sealed this

Fourteenth Day of January, 2003

JAMES E. ROGAN
*Director of the United States Patent and Trademark Office*